US005515705A

United States Patent [19]

Weldon et al.

[11] Patent Number: 5,515,705

[45] Date of Patent: May 14, 1996

[54] APPARATUS AND METHOD FOR DEFORMING A WORKPIECE

[75] Inventors: William F. Weldon, Austin, Tex.; Sulekh C. Jain, Cincinnati, Ohio

[73] Assignees: Board of Regents, The University of Texas System, Austin, Tex.; General Electric Company, Cincinnati, Ohio

[21] Appl. No.: 823,954

[22] Filed: Jan. 23, 1992

[51] Int. Cl.[6] ..... B21J 13/02

[52] U.S. Cl. ..... 72/19.1; 72/342.96; 72/342.92; 219/152

[58] Field of Search ..... 72/13, 37, 200, 72/342.92, 342.96; 219/81, 82, 83, 149, 150 R, 151, 152

[56] References Cited

U.S. PATENT DOCUMENTS

| | | | |
|---|---|---|---|
| 1,112,779 | 10/1914 | Forsyth | 219/149 |
| 2,473,245 | 6/1949 | Hanna | 219/152 |
| 2,890,324 | 6/1959 | Havlik | 219/151 |
| 3,399,290 | 8/1968 | Pardell | 219/150 |
| 3,988,914 | 11/1976 | Metcalfe et al. | 72/342.1 |
| 4,200,831 | 4/1982 | Weldon et al. | 322/8 |
| 4,473,738 | 9/1984 | Wolfe et al. | 219/152 |
| 4,532,793 | 8/1985 | Bezold | 72/342.96 |
| 4,544,874 | 10/1985 | Weldon et al. | 322/10 |
| 4,701,589 | 10/1987 | Larsson | 219/50 |
| 5,042,281 | 8/1991 | Metcalfe | 72/200 |
| 5,054,301 | 10/1991 | Soga et al. | 72/342.96 |

FOREIGN PATENT DOCUMENTS

| | | |
|---|---|---|
| 675731 | 2/1930 | France . |
| 992440 | 5/1965 | United Kingdom . |
| 2242378 | 10/1991 | United Kingdom . |
| 93/00587 | 5/1993 | WIPO . |

OTHER PUBLICATIONS

T. Aanstoos, R. Keith and W. Weldon, "Final Report on Heating of Forging Billets Using the Pulsed Homopolar Generator, " NSF/MEA 82011, submitted to National Science Foundation (Oct. 31, 1982).

DeGarmo, Black & Kohser, "The Fundamentals of Metal Forming," In Materials and Processes in Manufacturing, Sixth Edition, Chpt. 13, 323–359, 1984.

DeGarmo, P. E., "Hot Working Processes," Materials and Processing in Manufacturing, Fifth Edition, Chpt. 14, 354–387, 1979.

Aanstoos, Keith & Weldon, "Billet Heating with the Homopolar Generator," Center for Electromechanics, The University of Texas at Austin, Publication No. PN–80, 1982.

Weldon, Keith & Weldon, "Billet Heating with the Homopolar Generator," Second Annual Conference on Industrial Energy Conservation Technology, Houston, Texas, Apr. 13–16, 1980.

Keith & Weldon, "The Homopolar Pulse Billet Heating Process," Center for Electromechanics at the University of Texas at Austin, Publication No. PN–75, 1982.

Keith & Weldon, "Metal Heating with the Homopolar Generator," International Conference on Electrotechnologies in Industry, Montreal, Canada, May 25–27, 1982.

Walters & Aanstoos, "Welding Billet Heating with Homopolar Generators," Center for Electromechanics at The University of Texas at Austin, Publication No. PR–27, Published in *Metal Progress,* Apr., 1985.

(List continued on next page.)

*Primary Examiner*—Lowell A. Larson
*Assistant Examiner*—Thomas C. Schoeffler
*Attorney, Agent, or Firm*—Arnold, White & Durkee

[57] ABSTRACT

An apparatus and method is provided for controlling the temperature of dies and workpiece throughout a deformation process. Dies are capable of receiving external current to resistively heat the workpiece and dies during the deformation operation, the external current being modulated by feedback temperature readings taken from the workpiece. External current may be provided from a homopolar generator capable of producing pulsed dc current at controllable intervals and magnitudes simultaneously through the dies and workpiece.

13 Claims, 2 Drawing Sheets

OTHER PUBLICATIONS

Aanstoos, Keith & Weldon, "Heating of Forging Billets Using the Pulsed Homopolar Generator," Center for Electromechanics at The University of Texas at Austin, Publication No. PN–79, 1983.

"Electrical Heating of Forging Billets," Prepared by The Center for Electromechanics at The University of Texas as Austin, EPRI Em–2644 Project 1201–18, Final Report, Nov., 1982.

Aanstoos, Keith & Weldon, "Final Report on Heating of Forging Billets Using the Pulsed Homopolar Generator," The Center for Electromechanics at The University of Texas at Austin, 1–97, 1982.

FIG. 1
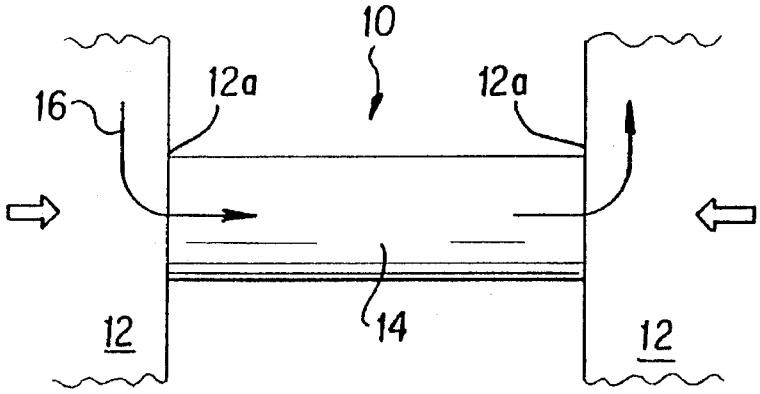
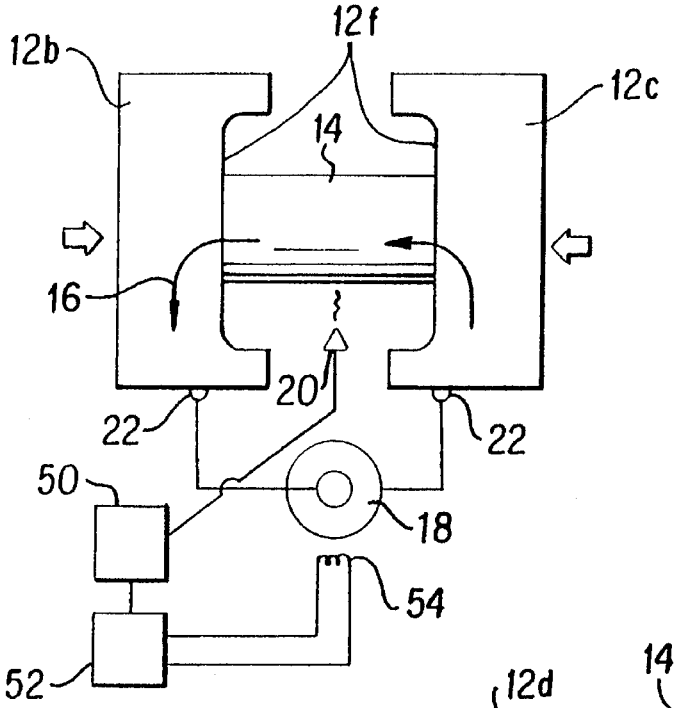
FIG. 2
FIG. 3
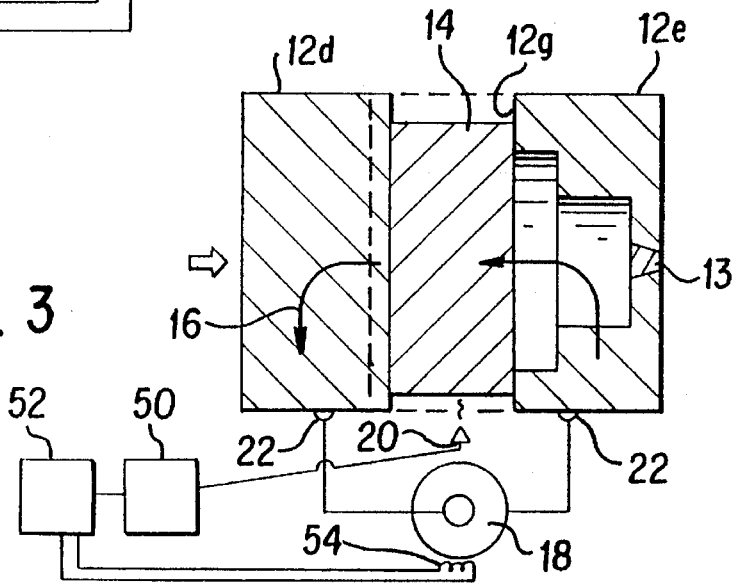

APPARATUS AND METHOD FOR DEFORMING A WORKPIECE

BACKGROUND OF THE INVENTION

I. Field of the Invention

This invention relates to an apparatus and method for deforming a workpiece. In particular, the apparatus and method of the present invention is suitable for regulating the temperature of one or more dies and a workpiece placed between the dies before, during and after deformation of the workpiece.

II. Description of the Relevant Art

In the manufacture of various workpieces, it is necessary to shape those workpieces by such methods as casting, machining, consolidating smaller pieces (i.e., welding) and deformation. Metal deformation is a process which exploits a remarkable property of metals—their ability to flow plastically in a solid state without concurrent deterioration of properties. Thus, a workpiece may be reshaped or deformed without losing its inherent strength, etc.

Deformation processes usually involve heating the workpiece prior and/or during a shaping or compression operation. However, cold-deformation can also be used. If the workpiece is heated above its recrystallization temperature, the workpiece deformation process is generally referred to as "hot working" the workpiece. Hot working is advantageous in that grain distortion is minimized during the deformation operation.

There are numerous hot working processes, several of which are rolling, forging, extrusion, pinch and roll, etc.

Rolling is usually the first step in converting a workpiece into sheets, plates, bars and strips of finished product. Basic rolling consists of passing a heated workpiece between two rolls that revolve in opposite directions. The space between the rolls is somewhat less than the thickness of the entering workpiece. Thus, the metal is squeezed and elongated, and usually changed in cross section. It is very important that the entering workpiece be heated uniformly throughout its cross-section. This usually requires prolonged heating at the desired temperature, a process known as soaking. Gas- or oil-fired soaking pits are often used to pre-heat the workpiece prior to it entering between the two rolls.

Forging is a thermomechanical process for shaping a solid workpiece by the application of force, either impact or continuous, to create a different geometry from that of the original workpiece or billet geometry. As used herein, forging includes open-die forging, closed die forging, swaging, heading, etc. Similar to rolling, the workpiece to be forged is usually heated to an elevated temperature at which the workpiece is malleable and/or ductile. The workpiece may be heated prior to forging, either in a fuel-fired furnace, indirect electric furnace, by electric induction, or direct electric resistance. Thus, like rolling, conventional forging devices generally utilize one of these four methods of heating the workpiece prior to placing a workpiece into a separate compression apparatus. Heating the workpiece prior to forging serves to lower the required force, increase the amount of deformation per compression, and control the final structure (the mechanical properties, the acoustical properties and the homogeneity) of the resulting forged part.

The extrusion process generally involves heating the workpiece and compressively forcing workpiece flow through a suitably placed die to form a product with reduced cross section. By compression upon one or more sides of the workpiece, portions of the workpiece are extruded as flash, for example, through an opening in one of the dies or the chamber surrounding the workpiece.

It is important to note that whatever deformation processes are chosen, whether it be rolling, forging, extrusion, etc., conventional hot-working processes generally involve preheating the workpiece by a separate apparatus from that of the device which performs the shaping or compression operation. Moreover, preheating may be performed in a completely separate chamber from the apparatus which performs the shaping/compression.

Commonly used pre-heating techniques are fairly simple to incorporate. Fuel-fired and electric furnaces consist of a thermally insulated box furnace having an elongated opening or slot for easy insertion and removal of the workpiece. A room-temperature workpiece can be inserted into the furnace and subsequently withdrawn at the forging temperature. The furnace is heated using either fossil fuels or electrically heated coils. Electric induction heating comprises induction coils powered at various current frequencies and amplitudes. Induced current within the workpiece causes heating of the workpiece at a current penetration depth which is a function of input power frequency and amplitude as well as workpiece conductivity and magnetic permeability. Direct resistance heating often utilizes a stepdown transformer with its secondary electrically connected across the workpiece. The transformer generally produces high alternating current which, through resistance of the workpiece, heats the workpiece to the desired temperature. A basic problem with resistance heating using stepdown transformers is that the alternating current from the transformer does not produce even heating throughout the bulk workpiece. In addition, such transformers are limited by practical considerations to output currents of 100,000 amps or less. This, in turn, limits the heating rate that may be achieved. Limited heating rates mean that all processes described above must be done "off-line" separate from the forging process.

Furnace heating, induction heating and resistance heating fed by stepdown transformers all are further limited by what is known as "skin effects." Skin effect generally results in an uneven temperature gradient across a cross-section of the workpiece. The above heating methods generally heat from the surface inward, whereby the temperature at the outer surface of the workpiece is substantially higher than that of the internal portion. In an effort to obviate these problems, homopolar generators can be used as a current source for direct current resistance heating of the workpiece. Homopolar generators provide a direct current source pulse which is unidirectional to allow resistive heating simultaneously throughout the workpiece cross-section, rather than from the surface inward. Keith, et al., "Electrical Heating of Forging Billets," *Electric Power Research Institute, Project* 1201-18, *Final Report* (November 1982); Aanstoos, et al., "Heating and Forging Billets Using the Pulsed Homopolar Generator," *Center for Electromechanics The University of Texas at Austin: Final Report* (Oct. 31, 1982).

Although resistive heating prior to compression or open-loop heating via homopolar generators produces a more uniform temperature gradient throughout the heated workpiece, open-loop resistive heating alone cannot provide strict temperature control during the forging process. Generally speaking, a conventional deformation process comprises a heating mechanism that is separate and distinct from the mechanism which performs compression shaping/compression. Thus, conventional deformation requires that a workpiece be heated to its recrystallization temperature in a heating mechanism such as a furnace or between conductive electrodes of a homopolar generator. Then, after the workpiece is heated, it is removed from the heating mechanism and placed between a pair of dies or die blocks. During the time in which the workpiece is removed from the heating mechanism and then placed between the dies, a considerable amount of heat may be lost from the surface of the workpiece. Furthermore, once the workpiece is in contact with the colder dies, it cools even more rapidly. Thus, once compression pressure is actually applied, workpiece temperature is unknown or workpiece temperature becomes nonuniform. Also, as the heated metal workpiece is compressed between dies, contact between the workpiece and die increases and heat is conducted away from the workpiece, primarily through contact with the die at a higher rate.

Temperature nonuniformity and out-migration of heat become particularly severe when high strength metal alloys and super alloys, such as titanium and nickel-based alloys, are being deformed. These temperature sensitive alloys are only deformable over narrow ranges of temperature and strain rate. Furthermore, conduction of the heat away from the surface of temperature sensitive alloys results in reduced plasticity of the surface material which in turn leads to surface fractures.

Traditional solutions to the problems created by out-migration of heat include: multiple reheating and compression cycles, hot-die working, isothermal deformation, and thermal insulation wrappings. Multiple heating and compression cycles increase microstructural grain size and lead to large in-process inventories. In hot-die working, the dies are typically preheated via conventional methods such as embedded electrical resistance heaters, electrical induction heaters or gas-fired heaters to some temperature above ambient, but below the workpiece deformation temperature, and the hot dies are then placed on the workpiece, whereby deformation then occurs. Warming the die reduces the loss of heat from the workpiece, but does not eliminate it and generally complicates the die and deformation apparatus. In isothermal workpiece deformation, the dies are heated to the same temperature as the workpiece, virtually eliminating conduction of heat away from the surface during the compression operation. However, in order to maintain the necessary die strength at elevated temperature, dies must be made from expensive alloys and the entire deformation mechanism must generally operate in an inert atmosphere, or vacuum, in order to prevent excessive oxidation of the die materials. Accordingly, isothermal deformation, to an even greater extent than hot-die working, requires a complicated mechanism which reduces the throughput of reshaped material.

SUMMARY OF THE INVENTION

The problems outlined above are in large part solved by the apparatus and method of the present invention. While conventional deformation devices described above contemplate a workpiece which is heated prior to and separate from a subsequent compression operation, the present invention comprises a deformation apparatus for simultaneously heating the dies and workpiece during at least a portion of the deformation operation or possibly throughout the deformation operation. Thus, the present invention provides pulsed d.c. electrical resistive heating of dies as well as the workpiece placed between the dies. Simultaneous heating of dies and workpieces during deformation (i.e., during either rolling, forging, extrusion, swagging heading, piercing, spinning, etc.) substantially prevents out-migration of heat away from the workpiece and thereby provides better control of workpiece temperature during both the initial heating and subsequent compression cycles). The present invention can thereby provide heating of the workpiece with the same apparatus which performs compression. Thus, the workpiece need not be removed from the heating mechanism and placed in the compression mechanism thereby allowing it time to cool prior to the compression cycle.

Simultaneous heating of dies and workpieces during hot-die deformation operation is accomplished by passing homopolar generator discharge current through the dies themselves as well as the workpiece. The dies, which operate as current carrying electrodes, function to resistively heat the workpiece as well as to apply compressive "shaping" force to the workpiece. One advantage of the present invention is the precise control of temperature which may be achieved through a preset energy level in the homopolar generator or through a feedback control to the homopolar generator from a thermocouple, pyrometer or other temperature sensitive device. Precise temperature control eliminates the need for external die-heating systems (induction, flame, infrared, etc.) or heating elements installed in passages within the die. The rapidity of the pulsed homopolar generator heating process makes it possible to minimize the time the die and workpiece are at an elevated temperature—a truly desirable outcome when forging temperature-sensitive alloys. Furthermore, the process allows forging at essentially constant temperature which eliminates the need for many repeated heating and shaping steps.

The present invention thereby provides bulk heating of a workpiece during deformation or compression. Bulk heating of the deformation apparatus can be employed in addition to or in lieu of the workpiece. Thus, the die may be preheated, or the die and workpiece (in combination) can be preheated prior to deformation. Moreover, the die (or workpiece and die) can be heated during at least a portion of the deformation cycle. Still further, the die (or workpiece and die) can be repetitively heated prior to, during or after deformation.

Broadly speaking, the deformation apparatus of the present invention comprises at least two dies movable toward one another during the deformation operation. Each die is capable of receiving external current during the deformation process. The temperature of the die and workpiece is regulated by modulating the external current which traverses the die and workpiece in series connection with a pulsed dc current source.

In another preferred embodiment, the deformation apparatus includes a feedback control placed between the workpiece and current source for modulating output from the current source in accordance with temperature readings taken from the workpiece. Feedback control includes a temperature sensor placed in thermal communication with the workpiece. An electrode placed on each die establishes a current path from the generator and simultaneously through both die and workpiece in response to temperature sensed by the sensor. Thus, the temperature sensor allows strict control of workpiece temperature throughout the deformation operation.

The present invention also contemplates a method for deforming a workpiece. This method comprises compressing a workpiece between a pair of dies while maintaining a substantially constant temperature of the workpiece by resistively heating the dies and workpiece during at least a part of the deformation operation.

As used herein, the term "deformation operation" includes an initial heating and subsequent compression and/or shaping operation. Initial heating can be maintained and regulated during the compression operation. Deformation operation may include either rolling, forging, extrusion, pinch and roll as described above, and more fully described in DeGarmo, *Materials and Processes in Manufacturing*, pp. 354–386 (MacMillan Pub. Co., 5th ed.), herein incorporated by reference. Forging, as used herein, contemplates open die forging, closed die forging, upset forging, swaging, etc. Initial heating preferably includes resistive heating of the workpiece and surrounding dies, wherein resultant workpiece temperature is brought at or near desired temperature. Once deformation temperature is achieved, compression or shaping of the workpiece occurs between at least two dies while some resistive heating is maintained within the workpiece and dies in accordance with the present invention. Thus, it is important to the present invention that resistive heating is achievable not only during initial heating, but also during subsequent compression and shaping, i.e., during at least a part of the entire deformation operation. Also, it is important that resistive heating be achieved using the same apparatus which performs compression, and that the workpiece need not be physically moved after initial heating and before subsequent shaping or compression.

As used herein, the term "dies" include forging dies, rollers, pinch-and-roll rollers, extrusion blocks/dies, upset "heading" dies, etc. Any conductive member used to compress upon or shape a deformable workpiece can be utilized as dies in accordance with the present invention.

BRIEF DESCRIPTION OF THE DRAWINGS

Other features and advantages of the invention will become apparent upon reading the following detailed description and upon reference to the accompanying drawings in which:

FIG. 1 is a perspective view of resistively heated dies and workpiece during a deformation operation in accordance with the present invention;

FIG. 2 is a perspective view of a temperature controlled current source for resistively heating dies and workpiece during a closed-die forging operation in accordance with the present invention;

FIG. 3 is a perspective view of a temperature controlled current source for resistively heating dies and workpiece during a closed-die forging operation in accordance with the present invention;

Figure 4:
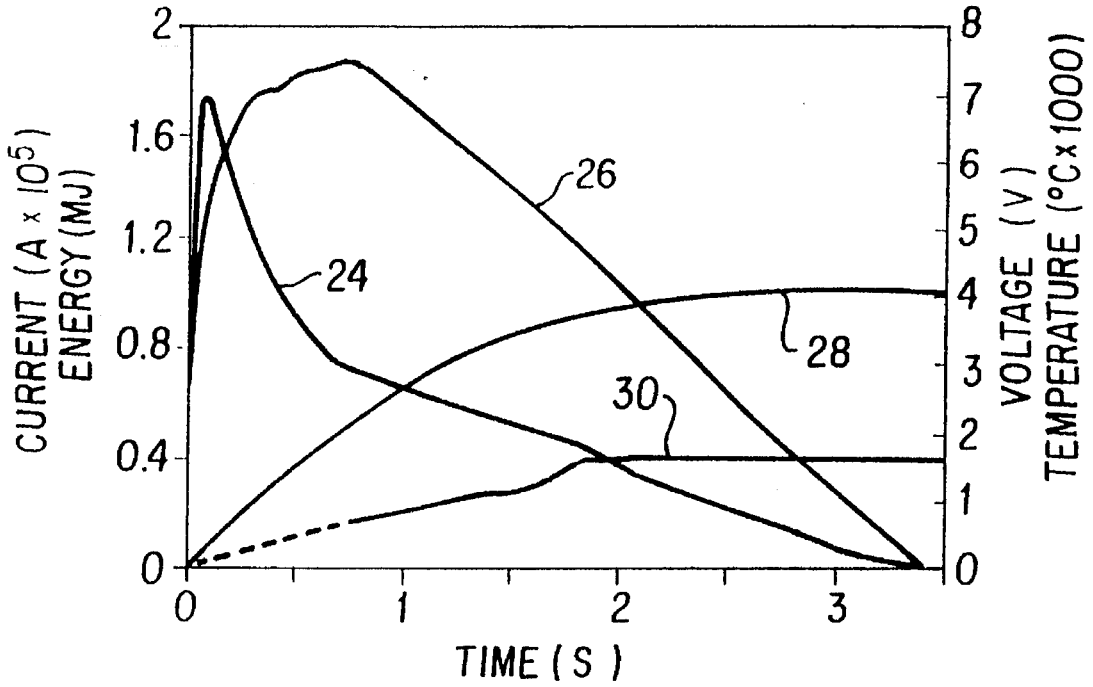
FIG. 4 is a graph of actual data taken for resistively heating a workpiece in accordance with the present invention.

While the invention is susceptible to various modifications and alternative forms, a specific embodiment thereof has been shown by way of example in the drawings and will herein be described in detail. It should be understood, however, that it is not intended to limit the invention to the particular form disclosed, but on the contrary, the intention is to cover all modifications, equivalents and alternatives falling within the spirit and scope of the invention as defined by the appended claims.

DETAILED DESCRIPTION OF THE INVENTION

Turning now to the drawings, a deformation apparatus 10 is illustrated in FIG. 1 comprising a pair of dies 12, movable toward one another during a deformation operation. One side 12*a* of each die 12 is brought in contact with opposite ends of workpiece 14. Electrical contact between dies 12 and workpiece 14 form series resistance between the die and workpiece combination capable of receiving a current path 16 through the combination. During the deformation operation, workpiece 14 is drawn between dies 12 which are capable of reciprocating toward one another and which may rotate in opposite direction from one another. As dies 12 come together and/or rotate, workpiece 14 is squeezed between dies 12 resulting in a deformed workpiece.

Apparatus 10 can have dies 12 designed and constructed to roll, forge, extrude, or pinch-and-roll workpiece 14 and to withstand high temperatures and large amounts of resistive heating simultaneous with large compressive forces. The inside surface 12*a* of dies 12 can be of any shape or contour depending upon the application desired. Dies 12 can, for example, have generally flat inside surfaces arranged in an open-die forging configuration such that an open-die hammer-and-press operation is achieved. Open die forging operation is capable of performing deformation in a discontinuous material flow in order to produce such shapes as: cylinders, flattened planar elements, mandrels and contours. Open dies can have substantially flat inner surfaces 12*a* and are axially directed toward one another and capable of receiving large amounts of current but which do not substantially deform during compression.

Resistive heating can be carried forth upon workpiece 14 having varying sizes, shapes and compositions. For example, workpieces having various aspect ratios (length-to-diameter ratios), ranging from large to small, can be heated. Furthermore, workpieces of continuous coils can be resistively heated at their deformation point in a continuous operation as well as workpieces which are ferromagnetic or nonferromagnetic. If workpiece aspect ratios exceed a specific value, such as four or five, reduced current may be necessary to resistively heat the workpiece. In addition, if the workpiece comprises low-conductivity material, less current may be needed. Typically, materials such as steel, carbon steel, stainless steel, high-conductivity aluminum, structural aluminum alloy, titanium and its alloys and super alloys of nickel, cobalt and iron, are used in the deformation process.

Thus, it is important to note that initial heating of a workpiece is a process in which comparatively large amounts of energy must be supplied to raise the temperature of entire volumes of metals or non-metals to high temperatures. In this respect, heating, in a forging environment, differs greatly from the class of processes that require localized energy, e.g., resistance welding. Keith, et al., "Electrical Heating of Forging Billets," *Electric Power Research Institute Project* 1201-18, *Final Report*, November 1982 (incorporated herein by reference). While resistance forging initially heats the entire bulk workpiece, resistance welding purposefully heats only the joint or facing region where the weld is formed.

FIG. 2 illustrates feedback control for regulating the output current from a current source 18 to dies 12 during a deformation process such as, e.g., a closed die forging process. Current from source 18 enters one die 12*c*, travels through workpiece 14 and out the other die 12*b* via path 16.

Current source 18 is preferably a pulsed dc source such as delivered by a homopolar generator (HPG), such as that disclosed in U.S. Pat. No. 4,544,874, the disclosure of which is incorporated herein by reference. When operated in the pulse mode, present HPG's are capable of delivering megampere-range current pulses of several seconds duration. The ends of workpiece 14 are axially contacted by curved, inner surface 12*f* which can shape workpiece 14 in a closed die forging process between inner surfaces 12*f* when dies 12*b* and 12*c* come together to enclose workpiece 14 on all sides. This form of deformation which includes closed-die forging as shown in FIG. 2 allows the introduction of current along current path 16. Using this method of closed-die forging, there appears little damage to the workpiece at current densities of up to about 125 kA/in$^2$ provided workpiece ends are generally flat and parallel to one another. If the spatial configuration is maintained, any form of pulsed power supply can be used provided the power supply selected can produce 500 kA to 1.5MA and anywhere from 1–10 Megajoule (MJ) output energy per pulse. Depending upon workpiece size, shape or composition either more or less stored energy output is needed. Workpiece volumetric size is preferably chosen to completely fill the space between die inner surfaces 12*f* when dies 12*b* and 12*c* are substantially compressed. Flash extrusion or excess workpiece volume is exited normal to axial compression of dies 12*b* and 12*c*. Complex nonsymmetrical shapes ranging from a few ounces to several tons can be closed-die forged in accordance with the present invention.

Shown coupled to current source 18 is a temperature sensor 20. Although any temperature sensing device may be employed, a preferred sensor 20 is an optical pyrometer such as a Vanzetti two-color optical pyrometer used to measure surface temperatures of workpiece 14 during heating and cooling cycles. The Vanzetti pyrometer consists of an optical head that views a 0.2 inch diameter spot from a working distance of approximately 24 inches. A fiber optic cable carries the sensed signal to two different monochrome filters, and a sensor then electronically converts the magnitudes of the filtered signals to temperature. Thus, preferred temperature sensor 20 does not physically contact the outer surface of workpiece 14. Instead, sensor 20 optically communicates thermal readings from workpiece 14. Instead of a pyrometer, other temperature sensing devices may be used such as a thermocouple. Furthermore, temperature sensor 20 may also be attached to one or more dies to provide temperature reading therein.

Temperature sensor 20 functions by obtaining temperature readings from workpiece 14 and relaying those readings to a controller 50 of common design which electrically controls the electrical signals received from sensor 20 and outputs those signals to a field power supply 52 of common design. Field supply then outputs field current to an HPG field coil 54. Field current through coil 54 then activates or regulates the HPG rotor voltage, e.g., the HPG current source 18. The rotor then can produce current to the dies 12*b* and 12*c*. Sensor 20 emits varying signals to controller 50 depending upon the relative temperature of workpiece 14. If, for example, workpiece 14 is cooler than the optimal deformation temperature, sensor 20 relays the appropriate signal causing field current to increase within coil 54 which in turn increases the current magnitude through path 16. Additional current causes additional heat generation within workpiece 14. Conversely, if workpiece 14 is hotter than optimal deformation temperature, sensor 20 relays that message via reduced field current which then decreases or discontinues current through current path 16. Thus, sensor 20 and source 18 work in conjunction to form closed-loop control between workpiece temperature and output current. Electrodes 22 placed on each die are capable of receiving current from source 18 and for simultaneously delivering that current through both dies 12*b* and 12*c* and workpiece 14 in response to temperature sensed by sensor 20.

FIG. 3 also illustrates feedback control within a closed die configuration. However, instead of both dies being moveable as in FIGS. 1 and 2, FIG. 3 shows only die 12*d* being moveable toward stationary die 12*e*. Furthermore, inner surface 12*g* of stationary die 12*e* includes a cavity of desired shape which accommodates workpiece 14 on all sides except that which contacts die 12*d* and that which extrudes at the interface between dies 12*d* and 12*e*. The extruded or excess portion of workpiece 14 is commonly referred to as "flash" in extrusion-type operative terminology. Also included in stationary die 12*e* is a knock out punch 13 having a radially tapered body which snugly fits into a receptacle having corresponding radially tapered walls placed completely through a portion of die 12*e*. Punch 13 is sized to fit completely within the receptacle and flush with the inner surface 12*g* as shown. Punch 13 may be made of any material which does not permanently adhere to die 12*e* and which can be inwardly removed from die 12 simultaneous with heated workpiece 14. Thus, punch 13 is placed prior to forging and can be simultaneously removed with workpiece 14 after forging is complete. Use of punch 13 alleviates the need for allowing workpiece 14 to completely cool before removing workpiece 14 via punch 13 from the closed-die mold arrangement.

The forging workpiece 14 may be placed in dies 12 at ambient temperature and heated by HPG discharge. Thus, handling of hot workpieces is eliminated or reduced and, the fact that the portion of the die in contact with the workpiece is also heated, will reduce or eliminate conduction of heat away from the workpiece during deformation process. Thus, an embodiment of the present invention involves electrically supplying heat to workpiece 14 during the deformation operation to replace heat lost through conduction convection and radiation and to maintain workpiece 14 at a constant (optimum) working temperature. Either a cold or preheated workpiece 14 is placed between cold or warm dies 12 and clamped in place by reduced compression pressure. An HPG discharge is used to initially heat the workpiece 14 to working temperature while simultaneously heating dies 12 to approximately the same temperature, but to a lesser degree because of reduced current density within dies 12. As the workpiece 14 reaches working temperature, compressive or shaping force is increased, thereby initiating the compression cycle of the deformation process. Compression upon the heated workpiece 14 causes it to deform or flatten in a direction roughly parallel to the applied stress and to grow in a direction roughly normal to the applied stress, thereby increasing the contact area between workpiece 14 and dies 12. This of course increases thermal conduction between the die and workpiece causing thermal out-migration from the workpiece if the workpiece and dies are not resistively heated during the compression cycle. To compensate for the heat loss during the compression process, HPG output is modulated causing infusion of heat back into the system. To a great extent, the heat compensation process will be self-regulating. Workpiece 14 itself will represent the major resistance in the HPG discharge circuit. This is necessary for efficient heating of workpiece 14 as the discharge current flow path 16 produces heat in the various circuit elements in proportion to their resistance. As the cross-sectional area of workpiece 14 and its contact area 12*a*, 12*f* or 12*g* with the die 12 are increased by the compression cycle, the current through the circuit will also naturally increase due to the reduced resistance of the workpiece 14. Control of HPG discharge can be utilized to further modulate the current as required to supply heat to workpiece 14 and maintain the desired temperature range as the deformation process progresses.

Generally speaking, the HPG discharge process begins by bringing the HPG rotor up to a predetermined discharge speed. The pieces of the resistive circuit, i.e., dies 12 and workpiece 14, are then electrically connected to form a conduction path therebetween. After reaching the desired speed, the HPG is discharged by exciting its field and dropping its brushes onto the surface of its spinning rotor. The resultant current pulse is conducted through the workpiece 14 and dies 12 where the unidirection electric current produces uniform heating throughout the cross-sectional area of workpiece 14. Workpiece 14 can heat very rapidly to forging temperature—i.e., within one to three seconds. Once forging temperature is reached, dies 12 are caused to be moved toward one another, usually by hydraulic or mechanical means, resulting in compressive forces upon the workpiece sufficient to reform or reshape it. Depending upon how much compression is needed, force transmitting means of various sizes, such as hydraulic cylinders or clamps, can be arranged upon dies 12 to cause their movement. Detailed design parameters of an exemplary HPG output utilized to heat workpieces to forging temperature is discussed in Keith et al., "The Homopolar Pulse Billet Heating Process," *Publication No. PN-75, Center for Electromagnetics, The University of Texas at Austin*, (April 4–7 1982).

Because the HPG billet heating process produces large unidirectional pulses of electric current, a substantially uniform temperature can be achieved throughout the die 12 and workpiece 14 cross-sections. Present HPG's are capable of delivering pulses in a time-controlled manner in response to demand signals from sensor 20. Thus, as cross-sectional area of workpiece 14 increases during compression, the current supplied by the HPG to workpiece 14 can be increased.

The relationship between HPG output and workpiece forging temperature is shown in FIG. 4. The graph of FIG. 4 illustrates actual data taken from heating a 1 kg steel workpiece using a HPG current source. DC current 24 peaks early in the forging process shortly after the time when the brushes are initially dropped onto the surface of the spinning HPG rotor. Maximum current level is approximately 173.5 kA and decreases to 0 kA in approximately 3.5 seconds.

The voltage drop across the billet 26 generally follows current 24 but with a certain time delay. This delay is due primarily to the increase in resistivity with temperature of the steel billet or workpiece. Voltage 26 is shown to achieve a maximum of approximately 7.5 volts in less than 1 second. The amount of energy thereby deposited in workpiece 14 is shown by curve 28 and peaks at approximately 1.02 MJ. A resulting substantially uniform temperature of 1580° C. can thereby be achieved in approximately 2 seconds for the sample 1 kg steel workpiece.

Figure 5:
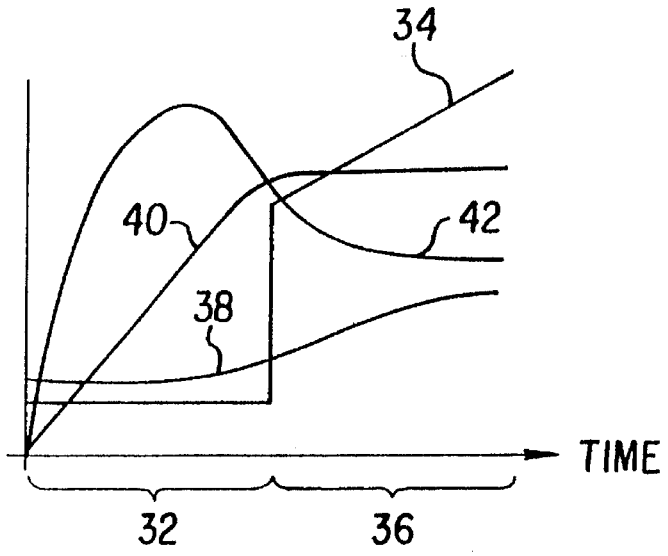
FIG. 5 is a graph of various readings taken during initial heating and subsequent compression of a workpiece in accordance with the present invention.

In order to maintain substantially constant deformation or working temperature during the compression stroke of, for example, a hydraulic press, heat loss compensation must be provided as shown in FIG. 5. The preferred embodiment of the present invention thereby involves electrically supplying heat to workpiece 14 throughout the initial heating and subsequent compression operation to replace heat lost through conduction, convection and radiation, in order to maintain the workpiece at optimum working temperature. A cold or preheated workpiece 14 is placed between cold or preheated dies and clamped in place by reduced pressure. An HPG discharge, as shown in FIG. 4, is used to initially heat workpiece 14 to working temperature as shown by reference numeral 32 in FIG. 5. After initial temperature is obtained, compressive force 34 is placed upon dies 12 as shown by reference numeral 36. By coupling electrical leads to dies 12 and routing current path 16 through the die and workpiece combination, workpiece temperature 40 is shown to increase during the initial heating stage 32.

Die temperature 38 does not reach the higher workpiece temperature 40 since workpiece current density is inherently higher than that of the dies. In other words, workpiece impedance or resistance is typically designed to be greater than die impedance or resistance. Various factors such as workpiece length/diameter ratio, workpiece composition, workpiece mass and shape all relate to the potential for workpiece temperature 40 to be greater than die temperature 38. Conversely, by carefully selecting size and composition of dies 12 relative to workpiece 14, most of the kinetic energy expended by the HPG is stored thermally within the workpiece instead of the die. Specifically, by making the cross sectional area of dies 12 greater than the cross-sectional area of workpiece 14, greater resistive heating will occur in the workpiece than in the dies. This lends itself to a more efficient heating circuit. Also, by minimizing stored heat within dies 12, a less expensive, less heat tolerant die material can be used. Furthermore, expensive, inert, non-oxidizing chambers will not be required in many cases for the present invention.

As further shown in FIG. 5, deformation with heat loss compensation of the present invention is achieved by maintaining a certain amount of controllable HPG current within dies 12 and workpiece 14 after initial heating 32 and during subsequent compression 36. By injecting predetermined amounts of HPG current 42 into the die and workpiece throughout the entire deformation operation, workpiece temperature 40 is maintained at a relatively constant temperature to compensate for out-migration of heat caused by conduction, convection and radiation.

The present invention will thus result in workpiece 14 being maintained at optimum working temperature throughout the deformation operation. Also, minimum heating of the dies 12 with respect to workpiece 14 is obtained as a benefit of the present invention. Thus, the present invention will reduce the number of heat and compression cycles required to complete a part, will allow the part to be deformed or shaped closer to final dimensions, and will reduce waste of expensive alloys.

The foregoing description of the present invention has been directed to particular embodiments. It will be apparent, however, to those skilled in the art that modifications and changes in both apparatus and method may be made without departing from the scope and spirit of the invention. Therefore, it is the applicants' intention in the following claims to cover all such equivalent modifications and variations which fall within the true spirit and scope of this invention.

What is claimed is:

1. Apparatus for deforming a workpiece, comprising:

two conductive dies compressible upon opposite faces of a metal workpiece;

an electrode electrically connected to each die;

a current source electrically connected in series between each electrode to provide pulsed DC current simultaneously through said dies and said workpiece; and a temperature sensor placed to sense a temperature of said workpiece and electrically coupled to said current source to regulate said pulsed DC current in response to temperature sensed.

2. The apparatus as recited in claim 1, wherein said current source comprises a homopolar generator.

3. The apparatus as recited in claim 1, wherein said workpiece and dies resistively heat in a substantially uniform manner across a cross-section of said workpiece and dies in response to said pulsed DC current.

4. The apparatus as recited in claim 1, wherein said current source produces current in response to temperature sensed such that workpiece temperature remains substantially constant during a time when said dies are compressed upon said workpiece.

5. Apparatus for deforming a workpiece, comprising:

two conductive dies compressible upon opposite faces of a metal workpiece;

an electrode electrically connected to each die;

a homopolar generator electrically connected in series between each electrode to provide pulsed DC current simultaneously through said dies and said workpiece; and a temperature sensor placed to sense a temperature of said workpiece and electrically coupled to said generator to regulate said pulsed DC current in response to temperature sensed.

6. The apparatus as recited in claim 5, wherein said workpiece and dies resistively heat in a substantially uniform manner across a cross-section of said workpiece and dies in response to said pulsed DC current.

7. The apparatus as recited in claim 5, wherein said homopolar generator produces current in response to temperature sensed such that workpiece temperature remains substantially constant during a time when said dies are compressed upon said workpiece.

8. A method for deforming a workpiece, comprising:

providing a pair of electrically conductive dies;

compressing a workpiece between said dies;

resistively heating said dies and workpiece by applying pulsed DC current through said dies and workpiece during said compressing step; and maintaining a substantially constant temperature of said workpiece.

9. The method as recited in claim 8, further comprising resistively heating said dies and workpiece prior to said compressing step.

10. The method as recited in claim 8, wherein said maintaining step comprises heating said dies and workpiece as a function of temperature of said workpiece.

11. The method of claim 10, further comprising:

sensing a temperature of said dies and workpiece; and adjusting the current supplied to said dies and workpiece in response to said sensed temperature.

12. The method as recited in claim 8, further comprising open-die forging said workpiece between said pair of dies while said workpiece and dies are resistively heated.

13. The method as recited in claim 8, further comprising closed-die forging said workpiece between said pair of dies while said workpiece and dies are resistively heated.

* * * * *